US005089114A

United States Patent [19]

Tovar et al.

[11] Patent Number: 5,089,114

[45] Date of Patent: Feb. 18, 1992

[54] METHOD FOR PROCESSING HEAVY CRUDE OILS

[75] Inventors: Abel M. Tovar, Tlalnepantla; Oscar H. B. Mendizabal, Satélite; Leonardo M. Olmos, Portales; Carlos G. A. Sanchez, Florida; Roberto L. Lorenzo, La Escalera; Roldofo C. Barba, Río Blanco; René H. Pérez, Tlalnepantla, all of Mexico

[73] Assignee: Instituto Mexicano Del Petroleo, Mexico

[21] Appl. No.: 439,670

[22] Filed: Nov. 22, 1989

Related U.S. Application Data

[63] Continuation-in-part of Ser. No. 274,687, Nov. 22, 1988, abandoned, which is a continuation of Ser. No. 679,368, Dec. 7, 1984, abandoned.

[51] Int. Cl.[5] ..... C10G 1/00

[52] U.S. Cl. ..... 208/50; 208/86; 208/95; 208/309; 208/87

[58] Field of Search ..... 208/86, 309, 44, 50, 208/87, 95

[56] References Cited

U.S. PATENT DOCUMENTS

| | | | |
|---|---|---|---|
| 2,847,353 | 8/1958 | Beavon | 208/73 |
| 2,925,374 | 2/1960 | Gwin et al. | 208/86 |
| 3,116,231 | 12/1963 | Adee | 208/50 |
| 3,379,639 | 4/1968 | Vallino, Jr. | 208/86 |
| 3,637,483 | 1/1972 | Carey | 208/78 |
| 3,951,781 | 4/1976 | Owen et al. | 208/145 |
| 3,998,726 | 12/1976 | Bunas et al. | 208/309 |
| 4,029,749 | 6/1977 | Murakami | 208/50 |
| 4,178,229 | 12/1979 | McConaghy et al. | 208/50 |
| 4,389,302 | 6/1983 | Garwin et al. | 208/87 |
| 4,859,284 | 8/1989 | Raimler et al. | 208/309 |
| 4,940,529 | 7/1990 | Beaton et al. | 208/86 |
| 5,013,427 | 5/1991 | Mosby et al. | 208/86 |
| 5,034,119 | 7/1991 | Blackburn et al. | 208/309 |

*Primary Examiner*—Olik Chaudhuri
*Assistant Examiner*—G. Fourson
*Attorney, Agent, or Firm*—Roylance, Abrams, Berdo & Goodman

[57] ABSTRACT

A method for processing heavy crude oils comprising a) atmospheric distillation of a heavy crude oil having a high content of metals, asphaltenes and sulfur; b) solvent extraction of the atmospheric distillation residue to obtain an extract with characteristics equivalent to those which an atmospheric residue derived from light crude oil and a raffinate fraction, solid at ambient conditions, in which are concentrated the asphaltenes, metals and sulfur present in the original crude oil; c) vacuum distillation of the deasphalted extract, obtaining a light fraction or gas oils with characteristics adequate to be subjected to a secondary conversion process, plus a bottoms fraction or vacuum residue; d) treatment of the vacuum gas oils in a conversion stage and e) subjecting the bottoms of raffinate from the extraction stage to a metallurgical process, in admixture with cokeable coal and coke fines to production of metallurgical coke.

10 Claims, 1 Drawing Sheet

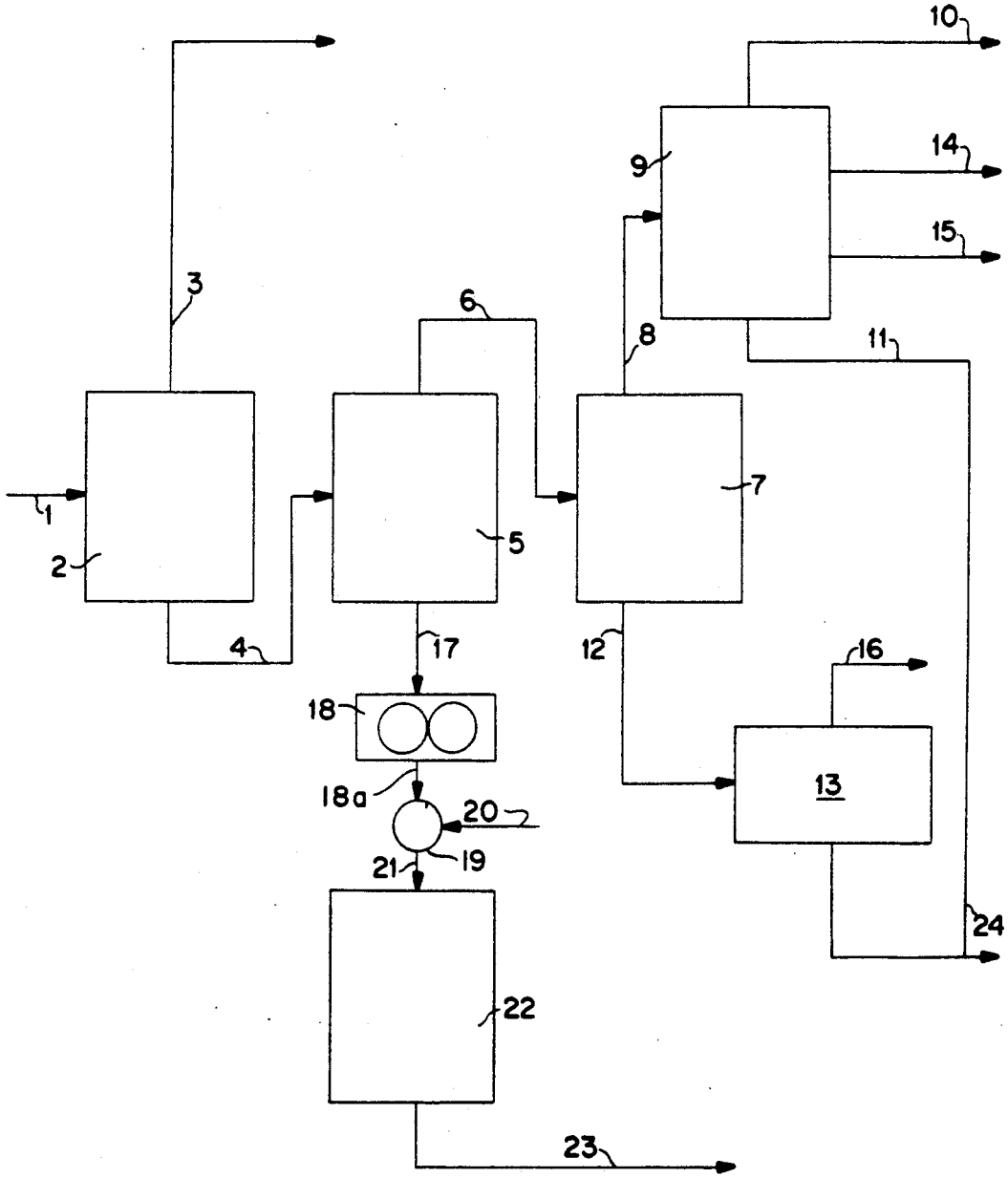
10
14
15
9
3
6
8
11
1
2
5
7
4
17
12
16
18
18a
20
13
21
19
24
22
23

METHOD FOR PROCESSING HEAVY CRUDE OILS

FIELD OF THE INVENTION

This invention is related to the integral exploitation of heavy crude oil to obtain the maximum recovery of light and intermediate hydrocarbons, through the incorporation of a solvent extraction stage into a conventional refining process. More particularly, the invention relates to the production of metallurgical coke and maximum production of light and intermediate fuels from the refining of a heavy crude oil with high contents of contaminants, mainly sulfur, metals, and asphaltenes, having, in addition, a residue yield greater than 55% at 350° C.

BACKGROUND OF THE INVENTION

In the last two decades there have been drastic changes in the pattern of petroleum fuel consumption, while the quality of the crude oil produced has notably diminished. In the industrialized countries, the environmental restrictions on pollutant emissions, such as sulfur and nitrogen oxides, the growth of the nuclear industry and the growing utilization of coal and natural gas in the generation of energy, have reduced the demand for residual fuels and increased the need for light and intermediate fuels like gasoline and jet and diesel fuel.

On the other hand, the percentage of heavy crude oils in proved world reserves has increased. As a result of this increase, the quality of the average mixture of crudes is constantly decreasing.

Consequently, the increasing demand for higher quality light fuels can only be covered, starting from residues and heavy crudes, by utilizing more stringent technologies.

Various technologies for treating barrel bottoms have been developed, particularly in the last two decades. However, such approach has centered on the conversion of vacuum residues of the crudes now processed, all of them light and intermediate types, although in some refineries heavy crudes are processed in mixtures with lighter crudes.

In fact, efforts made toward processing heavy crude have been few, because the majority of the world's refineries at present are set up to process light crudes.

The conventional process of extraction by solvent, classified among the techniques for the improvement of heavy fractions due to the elimination of carbon, constitutes an economical short term alternative for a conventional refinery ordinarily refining light crudes and in which heavy crudes are desired to be processed.

Traditionally, in the process of extraction with solvents, a vacuum residue is processed as in U.S. Pat. No. 2,847,353. Other processes such as U.S. Pat. No. 3,951,181, mix the vacuum residue with an atmospheric gas oil and feed it to the extraction section, thereafter processing the residue obtained by catalytic cracking. Other patents like U.S. Pat. No. 4,389,302 and U.S. Pat. No. 3,379,639 feed the residue obtained from the extraction process to a vis-breaking process.

Other processes such as those previously mentioned for U.S. Pat. No. 3,379,639, as well as for U.S. Pat. No. 3,637,483, feed atmospheric residues of light crudes into the process, obtaining a good quality extract which can be directly subjected to hydrotreatment as in U.S. Pat. No. 3,379,369 or else its vacuum residue as in U.S. Pat. No. 3,637,483. Also, in the latter (U.S. Pat. No. 3,637,483), this process is used as an important step in obtaining lubricants. Vacuum residue is used in feeding the extraction stage. The previously mentioned processes principally process light and intermediate crudes. The present invention is directed towards processing heavy crudes, and the residue of the extraction stage is not only used in asphalts, but is used to produce metallurgical coke in mixture with coals.

SUMMARY OF THE INVENTION

The present invention provides a refining process which will attain maximum recovery of distillates from a heavy crude oil, through the inclusion of a stage of extraction by solvent in a conventional process for the refining of light crudes. The process comprises:

a) Atmospheric distillation of a heavy crude oil with the special characteristic of having a high content of metals, asphaltenes and sulfur.

b) Extraction by solvent of the residue obtained from the atmospheric distillation, in order to obtain an extract with characteristics equivalent to those which an atmospheric residue obtained from light crude oil would have, and a bottoms fraction, solid at ambient conditions, in which are concentrated the asphaltenes, metals and sulfur present in the original crude oil. The handling of this bottoms fraction is impractical in conventional pumping systems..

c) Vacuum distillation of the deasphalted extract, obtaining a light fraction or gas oils with characteristics adequate for it to be subjected to a secondary conversion process, plus a bottoms fraction or vacuum residue.

d) Treatment of the vacuum gas oils in a conversion stage, preferably the process of fluid catalytic cracking (FCC), operating to obtain maximum recovery of gasolines.

e) Treatment of the residues with processing for residual materials, such as the moderate conversion viscosity breaking process of the vacuum residue, for the formulation of fuel oils, and admixing the extraction residues with coal for the preparation of coke in the metallurgical industry.

f) Subjecting the residue of the extraction stage in admixture with mineral carbons to a metallurgical coking process, for production of metallurgical coke.

In the invention herein described, the term "heavy crude oil" is used to identify crude oils with a specific gravity equal to or less then 25 API, containing a high concentration of sulfur (2–5% by weight), high contents of metals such as nickel, vanadium, copper and iron, mainly nickel plus vanadium in an amount between 200–500 ppm and high percentages of insolubles in heptane, that is, asphaltenes, with ratings over 5% by weight, up to 15% by weight.

In addition, in these crudes it is uncommon to obtain more than 50% of the distilled volume in intermediate distillates with a final boiling point of 350° C.

According to the present invention, the feedstock to the atmospheric distillation stage consists of a heavy crude oil having a high content of contaminants. This stage is operated conventionally to obtain naphtha and intermediate distillates with a final boiling temperature of 325° C. and an atmospheric residue with a boiling range above 325° C. It should be mentioned that this stage is unaffected by the quality of the crude, since the contaminating compounds tend to concentrate in the heavier fractions, particularly the organometallic compounds. For this reason, only small increments of sulfur will appear in the fraction having 325° C. of initial boiling point, this being counteracted by the greater stringency of the secondary stages of refining, which are the hydrodesulfuration of naphthas and intermediate distillates.

In the conventional refining scheme, the atmospheric residue boiling over 325° C., originating from the heavy residue, constitutes a very low quality feedstock for a vacuum distillation stage, since its high contaminant content severely limits the quality and quantity of gas oils to be obtained. It is here where the key incorporation of the extraction process with solvent takes place.

The atmospheric residue which is fed to the selective extraction process is worked so as to obtain a fraction, called the extract, of similar or better quality than an atmospheric residue from a typical light crude, plus an asphaltenic fraction or bottoms, in which the asphaltenes of the original heavy crude have been selectively concentrated, consequently containing a high percentage of the sulfur and organometallic compounds. It will be preferable to carry out the extraction process under the operating conditions and with the adequate solvent for obtaining the highest yield of an extract with characteristics similar to an atmospheric residue from a light crude. Operating in this way, the extraction bottoms will be made up of a material solid at ambient temperature, in which asphaltenes constitute at least 60% by weight of the heavy oil being refined.

The incorporation of the extraction process, placing it between the atmospheric distillation and vacuum distillation stages, is particularly advantageous because the subsequent conventional stages of vacuum distillation, fluid catalystic cracking and viscosity breaking will be fed by residual currents with properties equivalent to the load they would have if light crude were being refined. Therefore, no more stringent operation is required in these stages.

The vacuum distillation stage is fed by the extract coming from the extraction stage. The quality of this extract not only enables production of a gas oil of adequate quality so it can be subjected immediately to a catalytic cracking process, but also provides a high yield of this gas oil by being able to carry the distillation to a final gas oil boiling temperature of as much as 540° C., which would not take place if the atmospheric residue of the heavy crude were fed directly to the vacuum distillation stage, where the distillation must not exceed 460° if it is desired to obtain a gas oil adequate for feed the FCC process.

The gas oils obtained from vacuum distillation, with a final boiling temperature of at least 540° C. and a content of Ni+V metals less than 2 ppm, constitute an adequate feedstock to increase production of light distillates via processes of hydrocracking, thermal cracking or catalytic cracking.

In the process which is the object of this invention, fluid catalytic cracking using conventional process conditions is preferred, since it is the conversion process most widely used in refineries to convert gas oils into more valuable products like gasoline and intermediate distillates. The low content of metals, sulfur and residual carbon in these gas oils will favor the operation by diminishing the effect of loss of catalyst activity due to metal and coke deposits.

In the refining process of this invention, the vacuum residues from vacuum distillation are fed to the viscosity breaking process. The low metallic and asphaltene contents of the vacuum residue permit operation at medium and high severity conditions for prolonged periods and finally reduce the amount of diluent to be utilized for formulation of fuel oil.

An additional novel feature of this invention is the utilization of the asphaltic raffinate or bottoms from the extraction stage in a mixture with coking or cokeable coal and coke fines as a feed to a coke oven to produce metallurgical coke. Eighty to 90 percent by weight of the bottoms (raffinate) from the extraction stage of this invention are ground to a size of less than 3.2 or 3.17 mm and mixed with cokeable coal in proportions which can be 1 to about 10% by weight or greater of the raffinate based upon the total weight of the mixture. Coke is obtained from the present metallurgical coking process which meets the required specifications for sulfur, stability and hardness.

Use of raffinate from the extraction step for production of metallurgical coke differs from conventional use of asphaltenic residues in the petroleum industry. Previously, asphaltenic residues were subjected to delayed fluid coking or hydroconversion to obtain additional distillate. Likewise, such bottoms were mixed with light distillates to produce asphalt.

In contradistinction to such prior processes, the process of the present invention involves use of the raffinate from the extraction stage comprising asphaltenic residue as an agglutinant of cokeable or coking coal and coke breeze or fines, such fines having an average particle diameter of less than 20 mm. The coke fines or coke breeze in admixture with coking or cokeable coal and asphaltenic residue constitute a feed with the appropriate characteristics for producing metallurgical coke. Coking or cokeable coal is an art-recognized feed for producing metallurgical coke in coking ovens. Cokeable coal is placed in coke ovens and subjected to high temperatures to produce metallurgical coke, coke oven gases and coke breeze or fines. The by-product coke fines are normally disposed of as being unuseable. However, in the present invention, such material is reused by forming part of the asphaltenic raffinate-coal-coke fines mixture fed to the coke oven for producing metallurgical coke. This use of asphaltenes in the production of metallurgical coke provides an alternate more economical means for producing energy. Likewise, substitution of the asphaltenic fraction for a portion of the more expensive cokeable coal feed to coke ovens provides increased economy and savings for the production of such fuel.

This new use for an asphaltenic fraction is possible due to the characteristics of the asphaltic residue obtained by this invention. In conventional extraction processes, the asphaltenic bottoms or raffinate has a high oil content of greater than 60% by weight with a soft consistency. This consistency is reflected in its properties, such as: penetration of 8 to 40 (0.1 mm, at 25° C.); viscosity of 600 to 1600 in Saybolt seconds furol (at 121° C.); softening point of 70°-80° C.

Due to this soft consistency, it is not possible to directly use the raffinate or bottoms as feedstock to a conventional metallurgical coke process without further treatment or processing.

In the present invention, the resulting raffinate has a hard consistency. Its penetration is 0 when measured at 0.1 mm at 25° C. and viscosity cannot be measured at 121° C. The softening point is between 130° C.-150° C. Because of these properties, it is possible to directly feed the raffinate of the present invention to the grinder.

Additional characteristics of the raffinate or bottoms from the extraction process of the present invention are: solid at ambient temperature; density of 0.9 to 1.14 gr/cm$^3$; Ramsbottom carbon from 30 to 50% by weight; insoluble in n-heptane, from 50 to 80% by weight asphaltenes; metals (nickel +vanadium) 750 to 3000 ppm, and from 5 to 8% by weight sulphur.

The present invention utilizing the residue in such manner achieves an integral utilization of the heavy crudes with 25 or API less and high contaminant content (sulfur, metals and asphaltenes).

BRIEF DESCRIPTION OF THE DRAWINGS

The drawing is a flow diagram illustrating the method for processing heavy crude oils which is the object of this invention.

DETAILED DESCRIPTION OF THE INVENTION

In reference to the drawing, a heavy crude oil with 25 API or less and a high content of contaminants (especially sulfur, metals and asphaltenes) is fed via line 1 into distillation unit where distillation is performed under atmospheric pressure. Distillates with a final boiling temperature of 325° C. are removed via line 3.

Atmospheric residue recovered in distillation unit 2 is fed by means of line 4 to selective extraction unit 5. This atmospheric residue of a heavy crude is made up of all the hydrocarbons boiling above 325° C., and has low gravity values, °API (6.13), high sulfur and metal contents, mainly nickel and vanadium (2.6% by weight sulfur and 200–1600 ppm metals), high contents of residual carbon (10–18% weight) and asphaltene contents greater than 7% by weight.

One of the characteristics which best define a heavy crude is the presence of a high percentage of material formed by molecules of high molecular weight, over 4000, called asphaltenes. In this phase, the heavy metals are concentrated in the form of organometallic compounds. These compounds produce, with the residual +540° C. and even with gas oils in the boiling range of 325°-540° C., the difficulty in processing them in conversion plants to lighter, more valuable products, which, together with the residual carbon, is the cause of the accelerated deactivating of the catalysts of catalytic cracking, hydrocracking and hydrotreatment, besides causing problems of incrustations and adjustment in processing equipment. For this reason, an important feature of this refining process for heavy crude oils is the incorporation of selective extraction unit 5, located between the two units—atmospheric distillation unit 2 and vacuum distillation unit 7—with the object of selectively removing the asphaltenes and metals and operating the vacuum distillation unit 7 and subsequent stages with loads of a quality similar to that obtained in the conventional refining of light crude.

Extraction in unit 5 is conducted in the liquid state. Extraction is carried out utilizing as selective solvents, aliphatic hydrocarbons of four or more carbons (butane, isopentane, n-pentane, hexane and heptane), alone or in mixtures of the same.

The solvent used will depend on the nature of the heavy crude being refined and the quality desired in the extract which is to be fed via line 6 to vacuum distillation unit 7, the quality of the extract being similar to that of an atmospheric residue of light crude.

The amount of solvent employed, expressed in terms solvent/load, is 2 to 10 by volume.

The temperatures at which the extraction is to be carried out in a contactor varies between 40° to 250° C. The maximum permissible temperature shall be kept at least 25° C. below the critical temperature of the solvent used.

The temperature gradient between the top and bottom of the contactor will be maintained between 10° and 20° C. or a high as 30° C. The working pressure will depend on the nature of the solvent and the operating temperature, so as to insure extraction in liquid phase, which is approximately 5 Kg/cm2 higher than the vapor pressure of the solvent.

The stage of extraction of solvents yields as products a bottom stream, solid at ambient conditions, with a high concentration of asphaltenes and metals. Its characteristics are: density 0.9 to 1.4; Ramsbottom carbon 30 to 50% by weight; insolubles in $C_7$, that is to say, asphaltenes 50 to 80% by weight; metals (nickel +vanadium) 750 to 3000 ppm and sulfur 5 to 8% by weight. This stream is a raffinate stream withdrawn via line 17, while the stream withdrawn by line 6 is the extract formed by hydrocarbons in the boiling range of 350° C. +, in which a high percentage of the asphaltene fraction and the metals have been removed. This stream, of similar or better quality than an atmospheric residue coming from a typical light crude, has the following characteristics: API gravity of 10–18; insolubles in N-$C_7$ of 0.2 to 5.0% by weight; Ramsbottom carbon, 4 to 12% by weight; sulfur, 2 to 5% by weight and metals (nickel +vanadium), 75 to 250 ppm. The extract is withdrawn from the extraction stage via line 6 and fed to a vacuum distillation unit 7.

Vacuum distillation in unit 7 is performed in a conventional manner, providing at least a fraction of gas oil that meets the specifications for metal and sulfur content which enable it to be fed immediately into a catalytic conversion unit, preferably to the fluid catalytic cracking process 9, while a fraction in the boiling range of 540° C.+ is obtained from line 12. The initial boiling point fraction of 325° C. from line 6 comes from heavy crude which contains heavy components in high percentage. Yet, this 325° C.+ fraction has a unique characteristic, in that a large percentage of the asphaltene fraction and also the organometallic compounds have been eliminated in the preceding extraction by solvent stage 5.

The gas oils are fed via line 8 to the fluid catalytic cracking stage 9 which is operated under conventional conditions to obtain additional amounts of gas from line 10, gasoline from line 14, intermediate distillates from line 15, and cracking residues from line 11, thus avoiding problems which would result from treatment of a heavy crude with a high content of metals, asphaltenes and residual carbon.

The vacuum residue is removed via line 12 and is fed to a conventional viscosity breaking stage 13, operating in conditions adequate for the production of at least 10% naphtha, which is removed by 16, and a residue of lower viscosity than the residue fed in removed via line 24, with the amount of diluent reduced from the preparation of fuel oil at least 30%.

The raffinate or bottoms from solvent extractor 5 comprising the asphaltene fraction is withdrawn as bottoms from the deasphalting stage via line 17. In prior processes, this fraction is a substantially soft solid mass, whereas the asphaltenic raffinate fraction of the present invention is a sufficiently hard, non-soft solid which is solid at ambient temperature so that it can be passed directly to grinder 18 and ground into small particles. The raffinate is ground to finely divided particles having an average particle diameter of less than 3.2 mm, preferably less than 3.17 mm. The finely divided raffinate withdrawn via line 18a is mixed with finely divided coking coal, preferably having an average particle diameter of less than 3.2 mm and coke fines having an average particle diameter of less than 20 mm in mixing zone 19. The cokeable coal and coke fines are supplied via line 20. Suitable concentration ranges for the mixture include from about 1 to about 10 or more weight percent, preferably from about 3 to about 6 weight percent asphaltenic bottoms, from about 2 to about 10 preferably from about 6 to about 8 weight percent coke fines, with the remainder being cokeable coal. All percentages are based upon the total weight of the mixture. Mixing zone 19 represents any suitable mixing device or combination of devices. For example, a barrel mixer followed by an homogenizer can be utilized. The resulting mixture is fed via line 21 and subjected to metallurgical coking under suitable coking conditions in unit 22 of for example, a temperature in the range of from about 1100° to about 1400° C. preferably about 1350° C. under atmospheric pressure for a period of from about 15 to about 18 hours, preferably for about 16.5 hours, providing metallurgical coke which is withdrawn via line 23. The resulting metallurgical coke has characteristics suitable for use, for example, in a blast furnace for production of pig iron.

In order to better illustrate the process for the refining of heavy crudes, which is the object of this invention, an example is given of the processing of a particular heavy crude, without limiting for that reason the potential of this process for refining the whole range of crudes covered under the classification of heavy crudes.

EXAMPLE

Heavy crude oil is fed to a conventional atmospheric distillation unit. The distillation is carried out to a temperature of 325° C., providing 37% by vol. of distillates with an initial boiling point range of 325° C. and 63% vol. of residue with 325° C. +. The principal properties of the crude and the residue of 325° C.+ are shown in Table 1.

TABLE 1

CHARACTERISTICS OF THE HEAVY CRUDE OIL AND ATMOSPHERIC RESIDUE 325° C.+

| | Heavy Crude Oil | Atmosph. Residue 325° C.+ |
|---|---|---|
| % Volume of Crude | 100 | 63 |
| Degrees API | 21.8 | 9.9 |
| Sulfur, % by weight | 3.2 | 3.8 |
| Ramsbottom Carbon, % by weight | 10.4 | 16.2 |
| Insolubles in $nC_7$, % by weight | 10.8 | 15.9 |
| Nickel + Vanadium, ppm | 350 | 502 |

The atmospheric residue is subjected to a stage of extraction with pentane, selectively concentrating the asphaltenes and metals in the so-called bottoms phase, at the same time as an extracts similar in properties, particularly concerning the content of metals, sulfur and asphaltenes, to an atmospheric residue from light crude. Properties and load yields plus products of the extraction stage appear in Table 2.

TABLE 2

LOAD CHARACTERISTICS AND PRODUCTS OF THE DEASPHALTING OF ATMOSPHERIC RESIDUE

| | Extraction Load Atmosph. Residue 325° C.+ | Products | |
|---|---|---|---|
| | | Extract | Bottoms |
| % Volume of Crude | 63 | 44.3 | 18.7 |
| Degrees API | 9.9 | 16.5 | * |
| Sulfur, % by weight | 3.8 | 3.0 | 5.4 |
| Ramsbottom Carbon | 16.2 | 6.1 | 36.8 |
| Insolubles in $nC_7$, % by weight | 15.9 | 1.7 | 44.9 |
| Nickel + Vanadium | 502 | 115 | 1292 |

*solid at ambient temperature

Even though heavy crude is being refined, the extract of the deasphalting stage constitutes a very good quality load for vacuum distilling, without the problems inherent in a heavy crude due to its high content of contaminants. So the vacuum distilling is carried to the same depth as the distilling of an atmospheric residue from a light crude, giving the results in Table 3.

TABLE 3

LOAD CHARACTERISTICS AND PRODUCTS IN THE VACUUM DISTILLATION OF THE EXTRACT FROM THE EXTRACTION PROCESS

| | | Products | |
|---|---|---|---|
| | Extract | Gas Oil (325°–540° C.) | Residue (540° C.+) |
| % Volume of Crude | 44.3 | 25.6 | 18.7 |
| Degrees API | 16.5 | 21.5 | 10.0 |
| Sulfur, % by weight | 3.0 | 2.2 | 4.0 |
| Ramsbottom Carbon, % by weight | 6.1 | 0.2 | 13.6 |
| Insolubles in $nC_7$, % by weight | 1.7 | 0.0 | 3.9 |
| Nickel + Vanadium | 115 | 0.8 | 259 |

The vacuum distillation products are fed to the secondary conversion processes referred to in this invention: fluid catalytic cracking and viscosity breaking.

The processing of gas oils by the FCC process provides at least 40% by vol. of gasoline and 45% by vol. of distillates even including heavy cyclic oil, in a conventional plant.

As for the viscosity breaker plant operating at medium stringency, it provides at least 10% by volume of conventional plant gasoline, while decreasing by 33% the amount of diluent required in the residue for the production of fuel oil.

Referring now to the asphaltene fraction obtained from the extraction stage, it is ground so that, at least in 90% by weight of this fraction will have an average particle diameter of less than 3 mm. The ground bottoms are mixed with cokeable coal with the same size specifications, plus coke fines (size less than 0.5 mm). The mixture may contain amounts of bottoms from the extraction stage even greater than 10% by weight if desired.

Typical mixture used to obtain metallurgical coke.

| | % by Weight |
|---|---|
| Coal | 88 |
| Extraction bottoms | 4 |
| Coke fines | 8 |

The properties of this mixture are:

| | % by Weight |
|---|---|
| Volatile material | 24.6 |
| Ash | 13.4 |
| Fixed Carbon, % by weight | 62.0 |
| Sulfur | 1.2 |

The mixture is passed to a conventional coking oven where it is heated for about 16 hours at a temperature of 1300° C. under atmospheric pressure to provide metallurgical coke.

The properties of the coke obtained are:

| | |
|---|---|
| Volatile Material, % by weight | 0.8 |
| Ash, % by weight | 17.2 |
| Fixed Carbon, % by weight | 82 |
| Sulfur, % by weight | 0.98 |
| Stability, % by weight | 61.0 |
| Hardness, % by weight | 66.2 |

The metallurgical coke meets the quality specifications required by the steel industry.

It should be mentioned that with the key incorporation of the extraction stage, the production of intermediate distillates is at least 30% greater in volume than the production from refining a heavy crude via atmospheric distillation-vacuum distillation-FCC-viscosity breaker, as is shown in the following table.

| | Conventional Process* | Present Process** |
|---|---|---|
| Distillates, Bl | 32.5 | 62.5 |
| Residue, Bl | 67.9 | 38.3 |

*ATM-VACUUM-Viscosity Breaker
**ATM-EXTRACTION-VACUUM-Viscosity Breaker

What is claimed is:

1. A method for processing heavy crude oils, which comprises distilling a 100% heavy crude oil feedstock containing at least 7 weight percent n-pentane insolubles under atmospheric pressure to obtain an atmospheric distillation residue, contacting said atmospheric distillation residue with a selective solvent comprising $C_4$ to $C_7$ aliphatic hydrocarbon or mixtures thereof in an extraction column to extract asphaltenes, carbon, sulfur and metals from said atmospheric distillation residue, said extraction column having a top temperature of 50°-250° C., and a bottom temperature of 40°-230° C. while being operated under a pressure 3-40 kg/cm$^2$ with a solvent-hydrocarbon volume ratio of 2:1 to 10:1, withdrawing an extract fraction and a raffinate fraction rich in asphaltenes from said extraction column, said extract fraction having an API gravity of 10-18, an SSF viscosity at 50° C. of 100 to 3,500, 1.0-75 weight percent insolubles in n-pentane and 0.20-5.0 weight percent insolubles in n-heptane, a Ramsbottom carbon of 4.0-12.0 weight percent, 2.0 to 5.0 weight percent sulfur and 75 to 250 ppm metals comprising nickel and vanadium, subjecting said extract fraction to vacuum distillation in a vacuum distillation column at a temperature of 300° C. to 540° C. to recover a gas oil stream and a residue stream, catalytically cracking said gas oil stream and feeding said residue to a viscosity breaking unit and viscosity breaking the residue stream, and admixing said asphaltene-rich raffinate fraction with coking coal and coke fines and subjecting the resulting mixture to coking under conditions to produce metallurgical coke.

2. The process of claim 1, whereby the raffinate fraction is ground to finely divided particles having an average particle diameter of less than 3.2 mm and is used in admixture with said cokeable coal to produce said metallurgical coke.

3. The process of claim 2, wherein said raffinate fraction constitutes at least 4 weight percent of said admixture.

4. The process of claim 3, wherein said raffinate fraction constitutes from about 2 to about 10 weight percent of said admixture.

5. The process of claim 3, wherein said raffinate fraction is admixed with cokeable coal having a particle size less than 3.2 mm, and coke fines having a particle size of less than 20 mm.

6. The process of claim 1, wherein said raffinate fraction has a density of 0.9-1.4 g/cm$^3$, a Ramsbottom carbon of 30-50 weight percent, 60-90 weight percent n-pentane insolubles, 50-80 weight percent n-heptane insolubles, 5-8 weight percent sulfur and a melting point of 120°-200° C.

7. The process of claim 1, wherein said raffinate fraction contains 750-3,000 ppm metals comprising nickel and vanadium.

8. The process of claim 1, wherein said atmospheric distillation residue is a bituminous material having an initial boiling temperature of from 300° to 400° C.

9. The process of claim 1, wherein said selective solvent is normal pentane, normal hexane, or normal heptane.

10. The process of claim 1, wherein said coking is conducted at a temperature of from about 1100° to about 1400° C. under atmospheric pressure for a period of from about 15 to about 18 hours.

* * * * *